US005632664A

United States Patent [19]

Scoggan et al.

[11] Patent Number: 5,632,664

[45] Date of Patent: May 27, 1997

[54] FIELD EMISSION DEVICE CATHODE AND METHOD OF FABRICATION

[75] Inventors: John W. Scoggan, Southlake; Edward C. Lee, Dallas, both of Tex.

[73] Assignee: Texas Instruments Incorporated, Dallas, Tex.

[21] Appl. No.: 535,420

[22] Filed: Sep. 28, 1995

[51] Int. Cl.[6] ..... H01J 1/30; H01J 9/02

[52] U.S. Cl. ..... 445/50; 313/309; 313/336

[58] Field of Search ..... 445/50, 51; 313/309, 313/336

[56] References Cited

U.S. PATENT DOCUMENTS

| | | | |
|---|---|---|---|
| 3,998,678 | 12/1976 | Fukase et al. | 156/3 |
| 5,186,670 | 2/1993 | Doan et al. | 445/50 |
| 5,219,310 | 6/1993 | Tomo et al. | 313/336 |
| 5,374,868 | 12/1994 | Tjaden et al. | 445/51 |
| 5,451,830 | 9/1995 | Huang | 445/50 |

*Primary Examiner*—P. Austin Bradley
*Assistant Examiner*—Jeffrey T. Knapp
*Attorney, Agent, or Firm*—Christopher L. Maginniss; James C. Kesterson; Richard L. Donaldson

[57] ABSTRACT

A field emission device cathode (10) may be fabricated by forming a dielectric layer (14) on an upper surface of a resistive layer (12). A gate layer (16) is formed on the dielectric layer (14). An opening is formed in the gate layer (16) and a microtip cavity (18) is formed in the dielectric layer (14). The microtip cavity (18) extends through the opening in the gate layer (16) to the resistive layer (12). A conductive layer is formed on the gate layer (16) and the resistive layer (12) within the microtip cavity (18) to form a conductive opening layer (20) on the gate layer (16) and a microtip cavity layer (22) on the resistive layer (12). A nonrefractory metal layer is formed on the conductive opening layer (20) and the microtip cavity layer (22) to form a nonrefractory layer (26) on the conductive opening layer (20) and to form a microtip metal nonrefractory base layer (24) on the microtip cavity layer (22) such that the microtip metal nonrefractory base layer (24) serves as the base layer for a microtip (28) within the microtip cavity (18). A microtip metal refractory tip layer (30) is formed on the microtip metal nonrefractory base layer (24) to serve as the tip of the microtip (28). Finally, polishing is performed to remove a portion of the layers on the gate layer (16). The polishing continues until the microtip (28) is exposed.

16 Claims, 2 Drawing Sheets

FIELD EMISSION DEVICE CATHODE AND METHOD OF FABRICATION

TECHNICAL FIELD OF THE INVENTION

This invention relates in general to electron emitting structures, and more particularly to a field emission device cathode and method of fabrication.

BACKGROUND OF THE INVENTION

Field emission display technology may be used in a wide variety of applications including flat panel displays. The technology involves the use of an array of field emission devices. Each field emission device has an anode, cathode, and gate. Each field emission device cathode includes a microtip for emitting electrons. The fabrication of field emission device cathodes requires multiple steps. These fabrication steps are complex and require expensive materials and equipment. The fabrication steps also require a high degree of precision.

One common technique for fabricating cathode microtips involves high-angle evaporation of a sacrificial or "lift-off" layer followed by vertical evaporation of the microtip metal. The sacrificial layer is formed on top of the gate and on the edges of an opening in the gate. The openings in the gate begin to become restricted as the sacrificial layer is applied. As the microtip is formed through the opening and inside a cavity, the evaporated microtip metal also builds up on top of the sacrificial layer. The sacrificial layer, along with all of the overburden or subsequent microtip metal layers, is later "lifted-off" to preserve the underlying microtip and structure. The deposition and removal of this sacrificial layer is demanding and critical to proper device operation. One common technique of high-angle evaporation of a sacrificial layer is known as nickel evaporation in which a nickel layer serves as the sacrificial layer. However, the nickel layer tends to grab onto the gate layer, resulting in low reliability of the "lift-off" technique.

Another technique for applying a sacrificial metal layer is electroplating. One technique of electroplating is known as nickel electroplating. Nickel electroplating involves the application of a nickel layer to serve as the sacrificial layer during the fabrication of the cathode microtips. Just as in nickel evaporation, the sacrificial layer protects the integrity of the underlying microtip and structure. The sacrificial layer, along with all of the overburden, is later removed in the "lift-off" process. Nickel evaporation and nickel electroplating are expensive, time consuming, technically challenging, and sometimes unsuccessful. Further, the "lift-off" process does not always provide the desired separation of the nickel layer from the gate layer in order to expose the microtip.

Current techniques for fabricating cathode microtips use expensive refractory metals such as niobium and molybdenum. These refractory metals have a high melting point which is necessary when fabrication techniques such as high-angle evaporation are used. In order to conserve expensive refractory metals, the microtips are made smaller. Accordingly, the openings in the gate leading to the microtip must also be smaller and require the use of an expensive, high precision stepper to fabricate the openings in the gate.

SUMMARY OF THE INVENTION

From the foregoing it may be appreciated that a need has arisen for an improved method of fabricating a field emission device cathode. In accordance with the present invention, a method for fabricating a field emission device cathode is provided which substantially eliminates and reduces disadvantages and problems associated with fabricating field emission device cathodes using refractory metals and high precision steppers.

According to an embodiment of the present invention, there is provided a method for fabricating a microtip of a field emission device cathode that includes forming a dielectric layer on a resistive layer. The method also includes forming a gate layer on the dielectric layer and forming an opening in the gate layer. Next, the method includes forming a microtip cavity in the dielectric layer that extends from the upper surface to the resistive layer and forming a conductive layer on the gate layer and on the resistive layer within the microtip cavity. The method further includes forming a nonrefractory metal layer on the conductive layer to produce a microtip within the microtip cavity. Finally, the method includes polishing off the layers on the gate layer until the microtip is exposed.

According to another embodiment of the present invention, a field emission device cathode is provided that includes a resistive layer having an upper surface and a dielectric layer having an upper and lower surface with a microtip cavity extending from the upper surface to the lower surface, the dielectric layer engages the resistive layer such that the lower surface of the dielectric layer engages the upper surface of the resistive layer. A conductive layer having an upper and lower surface engages the resistive layer such that the lower surface of the conductive layer engages the upper surface of the resistive layer within the microtip cavity. A conical microtip, having a nonrefractory metal base layer and a refractory metal tip layer, is positioned within the microtip cavity of the dielectric layer. The conical microtip engages the conductive layer such that the nonrefractory metal base layer of the conical microtip engages the upper surface of the conductive layer. A gate layer having an upper and lower surface and a circular opening engages the dielectric layer such that the lower surface of the gate layer engages the upper surface of the dielectric layer and the circular opening is positioned above the conical microtip and the microtip cavity.

The present invention provides various technical advantages over using refractory metals for fabricating the microtips of field emission device cathodes and for using high precision steppers for fabricating field emission device cathodes. For example, one technical advantage of the present invention includes reduced fabrication cost due to the elimination or reduction of expensive refractory metals. Another technical advantage includes reduced fabrication time and higher product yields due to the use of lower precision steppers in the creation of larger diameter openings in the gate layers of the field emission device cathodes. Yet another technical advantage includes the elimination of the sacrificial layer step which may introduce defects in the fabrication process. Still another technical advantage includes the ability to control the size of the gate layer opening by polishing the gate layer to a predetermined depth. Other technical advantages are readily apparent to one skilled in the art from the following figures, description, and claims.

BRIEF DESCRIPTION OF THE DRAWINGS

For a more complete understanding of the present invention and the advantages thereof, reference is now made to the following description taken in conjunction with the accompanying drawings, wherein like reference numerals represent like parts, in which.

DETAILED DESCRIPTION OF THE INVENTION

Figure 1A:
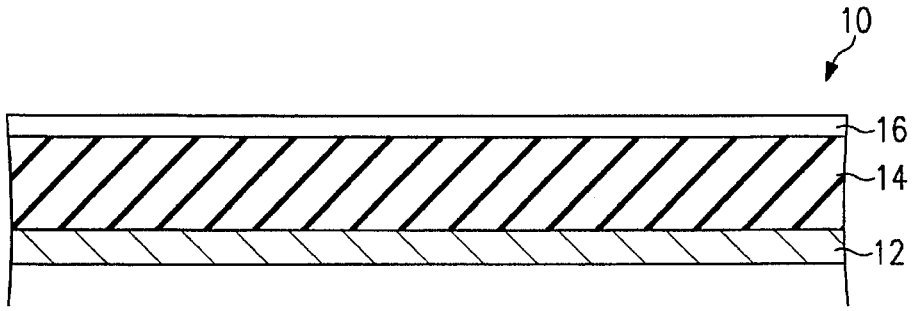
FIGS. 1A–1G illustrate the formation of a microtip of a field emission device cathode.

FIGS. 1A–1G illustrate the various stages occurring during the formation of a microtip of a field emission device cathode 10. FIG. 1A is a cross-sectional view of an early stage during the fabrication of field emission device cathode 10. A resistive layer 12, a dielectric layer 14, and a gate layer 16 are formed one on top of the other. Dielectric layer 14 is formed on an upper surface of resistive layer 12. Gate layer 16 is formed on an upper surface of dielectric layer 14. Resistive layer 12 may be constructed of materials that include amorphous silicon and dielectric layer 14 may be made of materials that include silicon dioxide.

Figure 1B:
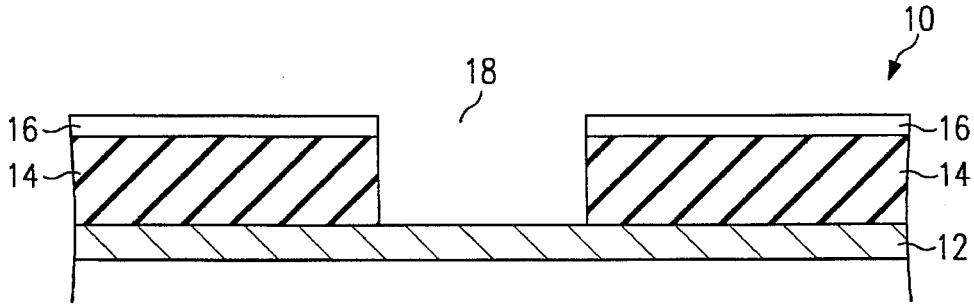

FIG. 1B is a cross-sectional view of a subsequent stage during the formation of field emission device cathode 10. A circular opening is created in gate layer 16 followed by the formation of a microtip cavity 18 within dielectric layer 14. Microtip cavity 18 extends from the circular opening in gate layer 16 to resistive layer 12. The circular opening in gate layer 16 is created with a stepper machine having a resolution or precision to create openings having a diameter of about two microns or greater. Thus, the circular opening in gate layer 16 will have a diameter of about two microns or greater.

Figure 1C:
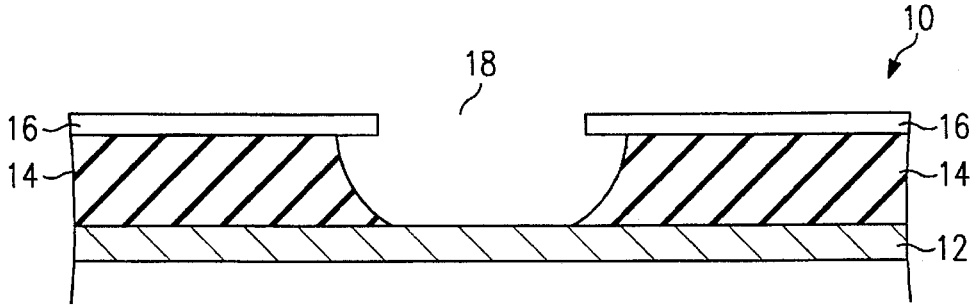

FIG. 1C is a cross-sectional view of a further stage during the formation of field emission device cathode 10. Microtip cavity 18 of dielectric layer 14 is further developed and expanded. Microtip cavity 18 is enlarged by removing additional interior portions of dielectric layer 14 through the circular opening in gate layer 16. Microtip cavity 18 may be further developed or enlarged by any available technique such as wet etching.

Figure 1D:
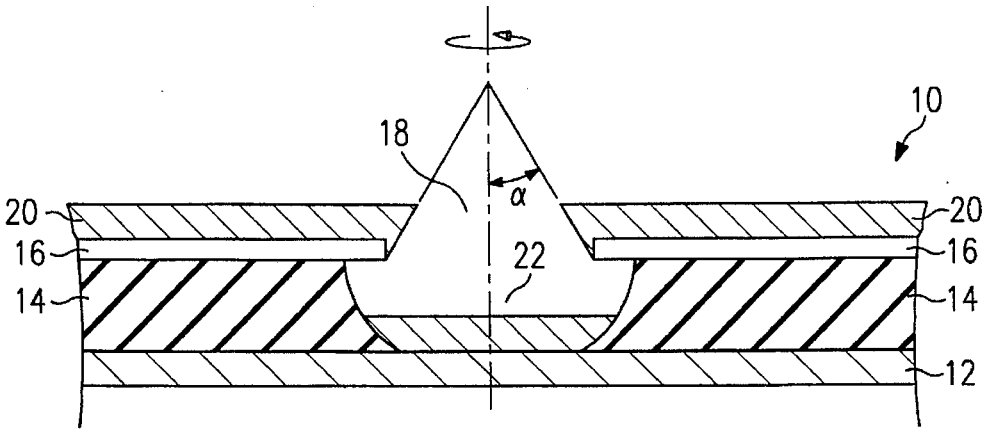

FIG. 1D is a cross-sectional view of still a further stage during the formation of field emission device cathode 10 illustrating further refinement of the circular opening leading to microtip cavity 18. A conductive layer is formed on gate layer 16 and on resistive layer 12 within microtip cavity 18. The conductive layer is formed at an angle $\alpha$. The conductive layer may be constructed from an inexpensive metal such as aluminum. This results in a conductive opening layer 20 being created on gate layer 16 and a microtip cavity layer 22 being produced on resistive layer 12 within microtip cavity 18. As shown in FIG. 1D, conductive opening layer 20 is formed at an angle $\alpha$ such that the diameter of the circular opening in gate layer 16 begins to close. The formation of conductive opening layer 20 includes the formation of a layer on the interior sidewall of gate layer 16 at the circular opening. The angle $\alpha$ controls the desired final diameter of the opening in gate layer 16 and the desired thickness of conductive opening layer 20. The angle $\alpha$ may be dependent on the equipment used to form conductive opening layer 20 and microtip cavity layer 22. The formation of conductive opening layer 20 on the interior sidewall of gate layer 16 reduces the diameter of the circular opening into microtip cavity 18 to about one micron or less. Microtip cavity layer 22 engages the upper surface of resistive layer 12 and the lower interior walls of microtip cavity 18 within dielectric layer 14.

Figure 1E:
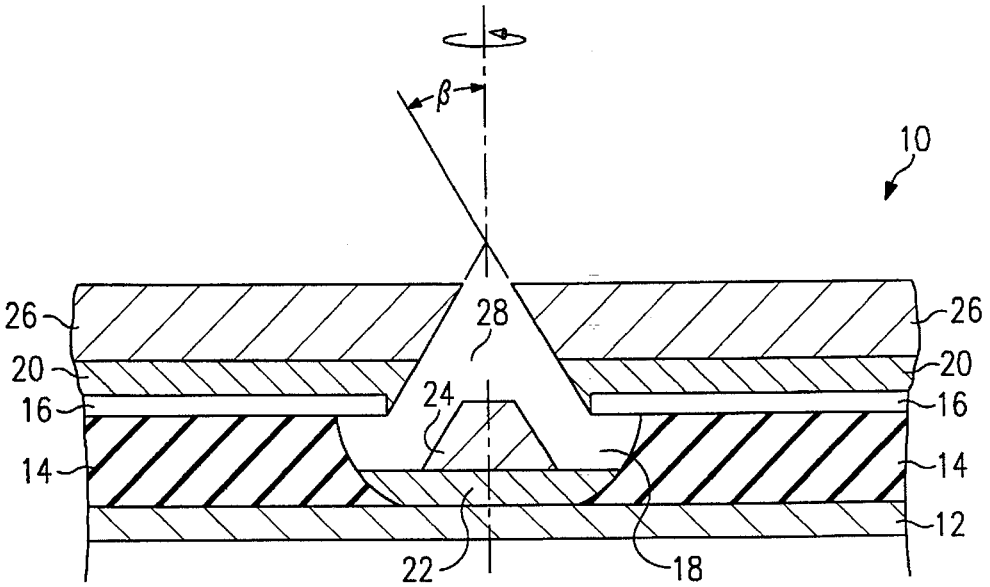

FIG. 1E is a cross-sectional view of a further stage during the fabrication of field emission device cathode 10. A nonrefractory layer 26 is formed at an angle $\beta$ on an upper surface of conductive opening layer 20. The formation of nonrefractory layer 26 also forms a microtip metal nonrefractory base layer 24 of a microtip 28. Microtip metal nonrefractory base layer 24 is formed on an upper surface of microtip cavity layer 22 and serves as a base layer of microtip 28 within microtip cavity 18. The angle $\beta$ controls the growth of microtip metal nonrefractory base layer 24. The angle $\beta$ and $\alpha$ may or may not be the same angle depending on the desired characteristics and fabrication equipment. The circular opening of gate layer 16 and conductive opening layer 20, continues to close or pinch-off. Nonrefractory layer 26 and microtip metal nonrefractory base layer 24 may be constructed from aluminum or any other inexpensive metal with similar or suitable characteristics. Expensive refractory metals with high melting points, such as molybdenum, niobium, chromium, and tungsten, are not required because of the elimination of the sacrificial layer step. The sacrificial layer step requires the dissolution of the sacrificial layer while keeping the underlying structure intact.

Figure 1F:
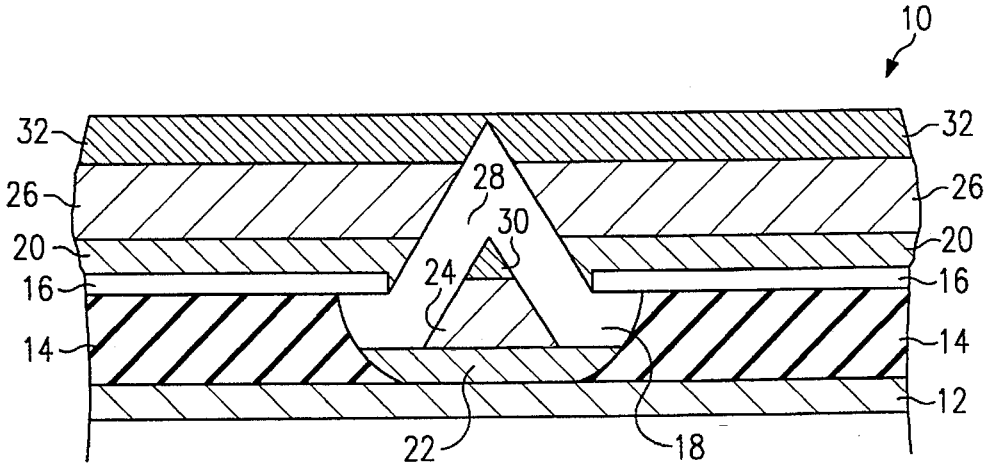

FIG. 1F is a cross-sectional view of one of the final stages of the formation of field emission device cathode 10. A refractory layer 32 is formed on the upper surface of nonrefractory layer 26. In the process of forming refractory layer 32, a microtip metal refractory tip layer 30 is created on microtip 28. Microtip metal refractory tip layer 30 serves as the tip or final layer of microtip 28 and may constitute a very small percentage of the overall height of microtip 28. The formation of refractory layer 32 closes the opening in gate layer 16 and conductive opening layer 20 to enclose microtip 28. Refractory layer 32 may be applied vertically or at an angle similar to $\alpha$ or $\beta$, depending on the desired thickness of refractory layer 32 and microtip metal refractory tip layer 30. Refractory layer 32 and microtip metal refractory tip layer 30 may be constructed from molybdenum to utilize certain properties of refractory metals in forming microtip metal refractory tip layer 30. Though a nonrefractory metal may be used, microtip metal refractory tip layer 30 provides hardness and definiteness to microtip 28.

Figure 1G:
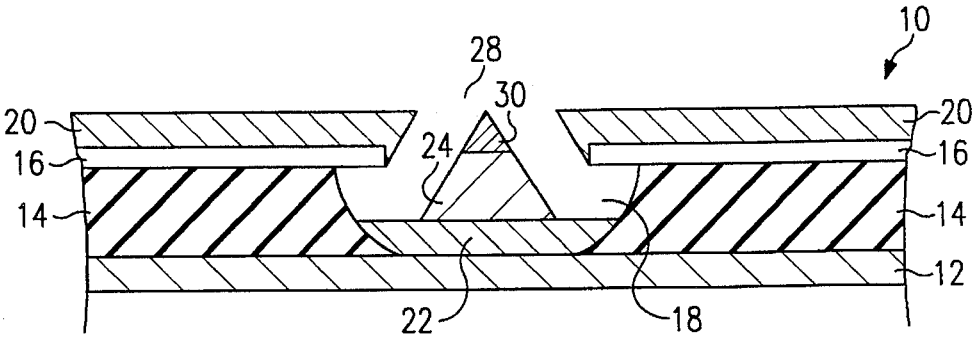

FIG. 1G is a cross-sectional view of the final fabrication stage of field emission device cathode 10. Refractory layer 32 and nonrefractory layer 26 are removed or polished off the upper surface of conductive opening layer 20. The polishing step is accomplished through the use of a technique known as chemical mechanical planarization. Chemical mechanical planarization is a polishing technique for removing a portion of a surface to produce a flat surface. Chemical mechanical planarization is applied to refractory layer 32 and nonrefractory layer 26 to remove these layers and provide an appropriate circular opening exposing microtip 28. All or a portion of conductive opening layer 20 remains on gate layer 16 to provide a proper or desired opening dimension to expose microtip metal refractory tip layer 30 of microtip 28.

In operation, field emission device cathode 10 serves as a source of electrons. A voltage or potential difference is applied across gate layer 16 and microtip 28. The voltage or potential difference causes the emission of electrons from microtip 28 for use in field emission device technology such as flat panel displays.

Various alternatives to the present invention, as detailed in the one embodiment shown in FIGS. 1A–1G, are discussed more fully below. During the formation process of field emission device cathode 10, any fabrication or deposition technology may be used to produce these results. For example, fabrication techniques such as metal evaporation, high-angle evaporation, sputtering, etching, and wet etching may all be used during the formation or fabrication process.

Any of a variety of materials may be used in the fabrication of field emission device cathode 10. Gate layer 16 may be fabricated using a refractory metal such as niobium or a nonrefractory metal such aluminum. Less expensive, nonrefractory metals with suitable performance characteristics may be used in place of the more expensive refractory metals. Microtip 28 is shown in FIG. 1G as having been formed or fabricated from two distinct metal layers. Microtip 28 may be constructed from a single metal layer or from multiple layers of different metals. The shape of microtip 28 may be conical or any other shape which produces a tip at the opening in gate layer 16. The circular opening in gate layer 16 and conductive opening layer 20, which surrounds microtip metal refractory tip layer 30 of microtip 28, may be configured in other geometric shapes. The opening may be configured in any geometric shape which allows field emission device cathode 10 to serve as a supplier of electrons once a potential difference is applied across gate layer 16 and microtip 28.

The size of the opening leading to microtip cavity 18 may be varied. FIG. 1F and FIG. 1G illustrate the results of the polishing step or chemical mechanical planarization to create an opening to microtip cavity 18 and microtip 28. The diameter of the opening decreases when moving from the opening at gate layer 16 to the opening at the upper surface of conductive opening layer 20. The diameter may change from about two microns or more to about one micron or less. Depending on the desired size of the opening, chemical mechanical planarization may be applied to a predetermined depth to produce a desired opening size. In fact, chemical mechanical planarization may be stopped before all of refractory layer 32 or nonrefractory layer 26 are removed from the upper surface of conductive opening layer 20. This results in an opening with a smaller diameter. Other polishing techniques may be used instead of chemical mechanical planarization. Any polishing technique that can remove a layer of metal may be used.

Another alternative to the present invention, as described in the one embodiment shown in FIGS. 1A–1G, involves the elimination of gate layer 16 as shown in FIG. 1A. This alternative embodiment of the invention proceeds according to the steps as shown in FIGS. 1A–1G except that conductive opening layer 20 is formed directly on dielectric layer 14. The circular opening to microtip cavity 18 can be created through conductive opening layer 20. In essence, conductive opening layer 20, nonrefractory layer 26, and refractory layer 32 serve as the gate layer for field emission device cathode 10. These layers may then be polished to produce a gate layer of a desired depth with an opening of a desired size or diameter.

In summary, the prevent invention provides various technical advantages for fabricating field emission device cathodes. These advantages include reduced fabrication costs due to the elimination or reduction of expensive refractory metals. Less expensive nonrefractory metals may be used due to the elimination of the sacrificial layer step. The elimination of the sacrificial layer step provides the technical advantage of reduced fabrication time and increased reliability because of the elimination of short circuits, limited gate layer openings, and incomplete "lift-off." Another advantage of the present invention includes the elimination of the requirement for using expensive and complex large area steppers to create a pattern of gate layer openings having very small openings with diameters of about one micron. Gate layer openings of two microns or more may be more easily fabricated using less expensive and less complex equipment and techniques. The gate layer opening diameters may be further reduced to the desired size by applying a conductive opening layer which forms on the interior sidewall of the gate layer at the initial opening. Still another advantage of the present invention includes the ability to control the size of the gate layer opening by controlling the depth of the polishing or chemical mechanical planarization used to expose the microtip.

Thus, it is apparent that there has been provided, in accordance with the present invention, a field emission device cathode and method of fabrication that satisfy the advantages set forth above. Although the preferred embodiment of the present invention has been described in detail, it should be understood that various changes, substitutions, and alterations can be made herein without departing from the spirit and scope of the present invention as defined by the appended claims.

What is claimed is:

1. A method for fabricating a microtip of a field emission device cathode, comprising the steps of:

forming a dielectric layer on a resistive layer;

forming a gate layer on the dielectric layer;

forming an opening in the gate layer;

forming a microtip cavity in the dielectric layer through the opening in the gate layer that extends to the resistive layer;

forming a conductive opening layer on the gate layer and on the resistive layer within the microtip cavity;

forming a nonrefractory metal layer on the conductive opening layer and on the conductive opening layer within the microtip cavity to produce a microtip within the microtip cavity; and polishing the field emission device cathode until the microtip is exposed.

2. The method of claim 1, wherein the polishing step includes using chemical mechanical planarization.

3. The method of claim 1, wherein the forming a nonrefractory metal layer step includes the creation of a conical microtip.

4. The method of claim 1, wherein the forming an opening step includes forming a circular opening with a diameter of about two microns or greater.

5. The method of claim 4, wherein the conductive opening layer and the nonrefractory metal layer include aluminum.

6. The method of claim 1, wherein the forming a conductive opening layer step further includes forming a conductive opening layer on the interior sidewall of the gate layer at the opening such that the diameter of the opening is reduced.

7. The method of claim 6, wherein the forming a conductive opening layer step further includes reducing the diameter of the opening to about one micron or less.

8. The method of claim 1 further comprising the step of forming a refractory metal layer on the nonrefractory metal layer to produce a refractory metal tip on the microtip within the microtip cavity.

9. The method of claim 8, wherein the conductive opening layer and the nonrefractory metal layer include aluminum, and the refractory metal layer includes molybdenum.

10. The method of claim 8, wherein the forming a refractory metal layer step further includes the production of a conical microtip.

11. A method for fabricating a microtip of a field emission device cathode, comprising the steps of:

forming a dielectric layer on a resistive layer;

forming a microtip cavity in the dielectric layer that extends to the resistive layer;

forming a conductive opening layer on the dielectric layer and on the resistive layer within the microtip cavity, the conductive opening layer on the dielectric layer having an opening over the microtip cavity;

forming a nonrefractory metal layer on the conductive opening layer and on the conductive opening layer within the microtip cavity to produce a microtip within the microtip cavity; and polishing off the field emission device cathode using chemical mechanical planarization until the microtip is exposed.

12. The method of claim 11 further comprising the step of forming a refractory metal layer on the nonrefractory metal layer to produce a refractory metal tip on the microtip within the microtip cavity.

13. The method of claim 12, wherein the forming a conductive opening layer and nonrefractory metal layer include aluminum, and the refractory metal layer includes molybdenum.

14. The method of claim 11, wherein the forming a conductive opening layer step includes forming a circular opening in the conductive opening layer with a diameter of about two microns or greater.

15. The method of claim 14, wherein the forming a conductive opening layer step further includes reducing the diameter of the circular opening to about one micron or less.

16. The method of claim 14, wherein the conductive opening layer and the nonrefractory metal layer include aluminum.

* * * * *